US011028691B2

(12) United States Patent
Gong et al.

(10) Patent No.: US 11,028,691 B2
(45) Date of Patent: Jun. 8, 2021

(54) DRIVE SYSTEM WITH BOTH FIXED-DISPLACEMENT HYDRAULIC MOTORS AND VARIABLE-DISPLACEMENT HYDRAULIC MOTORS FOR CUTTER HEAD OF BORING MACHINE AND CONTROL METHOD THEREOF

(71) Applicant: ZHEJIANG UNIVERSITY, Zhejiang (CN)

(72) Inventors: Guofang Gong, Zhejiang (CN); Xu Yang, Zhejiang (CN); Lintao Wang, Zhejiang (CN); Chao Wang, Zhejiang (CN); Yakun Zhang, Zhejiang (CN); Weiqiang Wu, Zhejiang (CN); Tong Liu, Zhejiang (CN); Liwen Duan, Zhejiang (CN)

(73) Assignee: ZHEJIANG UNIVERSITY, Zhejiang (CN)

( * ) Notice: Subject to any disclaimer, the term of this patent is extended or adjusted under 35 U.S.C. 154(b) by 265 days.

(21) Appl. No.: 16/335,667

(22) PCT Filed: Dec. 21, 2016

(86) PCT No.: PCT/CN2016/111296

§ 371 (c)(1),
(2) Date: Mar. 21, 2019

(87) PCT Pub. No.: WO2018/112792

PCT Pub. Date: Jun. 28, 2018

(65) Prior Publication Data

US 2020/0032650 A1 Jan. 30, 2020

(51) Int. Cl.

| | |
|---|---|
| ***E21D 9/10*** | (2006.01) |
| ***E21D 9/093*** | (2006.01) |
| *E21B 4/00* | (2006.01) |

(52) U.S. Cl.
CPC ..... *E21D 9/093* (2016.01); *E21D 9/1086* (2013.01)

(58) Field of Classification Search
CPC . E21D 9/1086; E21D 9/10; E21B 4/00; E21B 4/16; E21B 7/00

(Continued)

(56) References Cited

U.S. PATENT DOCUMENTS 5,159,992 A * 11/1992 Reinecke ..... F16H 47/02 180/307
7,588,103 B2 * 9/2009 Iwaki ..... B60K 17/356 180/6.32

(Continued)

*Primary Examiner* — Gloria R Weeks

(57) ABSTRACT

A drive system with both fixed-displacement hydraulic motors and variable-displacement hydraulic motors for a cutter head of a boring machine and a control method thereof are provided. The drive system includes a variable-displacement hydraulic motor group, a fixed-displacement hydraulic motor group and a variable-displacement hydraulic pump group. The variable-displacement hydraulic motor group, the fixed-displacement hydraulic motor group, and the variable-displacement hydraulic pump group are all connected to a main oil circuit of a cutter head system of the boring machine. The variable-displacement hydraulic pump group inputs flow to the main oil circuit; and, the variable-displacement hydraulic motor group and the fixed-displacement hydraulic motor group acquire flow from the main oil circuit. Displacements of the fixed-displacement hydraulic motor group and the variable-displacement hydraulic motor group are set in a way of specific displacement combination. The present invention decreases an engineering cost, and improves system reliability and efficiency.

20 Claims, 2 Drawing Sheets

(58) Field of Classification Search
USPC ..... 173/213, 222
See application file for complete search history.

(56) References Cited

U.S. PATENT DOCUMENTS

| | | | | |
|---|---|---|---|---|
| 7,640,998 | B2 * | 1/2010 | Howell, Jr. | E21B 7/023 173/184 |
| 8,118,113 | B2 * | 2/2012 | Wrede | E21B 7/022 173/148 |
| 9,005,079 | B2 * | 4/2015 | Pette | F16D 31/00 477/6 |
| 2001/0003317 | A1 * | 6/2001 | Klemm | F16H 61/44 173/222 |

* cited by examiner

DRIVE SYSTEM WITH BOTH FIXED-DISPLACEMENT HYDRAULIC MOTORS AND VARIABLE-DISPLACEMENT HYDRAULIC MOTORS FOR CUTTER HEAD OF BORING MACHINE AND CONTROL METHOD THEREOF

CROSS REFERENCE OF RELATED APPLICATION

This is a U.S. National Stage under 35 U.S.C 371 of the International Application PCT/CN2016/111296, filed Dec. 21, 2016.

BACKGROUND OF THE PRESENT INVENTION

Field of Invention

The present invention relates to a technical field of tunnel boring machine, and more particularly to a drive system with both fixed-displacement hydraulic motors and variable-displacement hydraulic motors for a cutter head of a boring machine and a control method thereof, so as to maximize a working efficiency of a tunnel boring machine, improve system reliability and decrease an engineering cost.

Description of Related Arts

The tunnel boring machine is widely applied in the national infrastructure engineering, such as water supply engineering, electric power engineering, road construction and urban subway, which is a large-scale underground engineering mechanical device involving multi-disciplinary fields of mechanics, electricity and liquid; and the main body of the tunnel boring machine comprises a cutter head, a drive system for the cutter head, a propulsion system and a shield support system.

The cutter head hydraulic system is an important part for guaranteeing realization of the forward boring work of the boring machine. Generally, the boring machine is at a severe working condition and is faced with complex and varied geological conditions, which requires the main drive system of the cutter head to provide relatively large power and torque. In order to increase the boring speed of the boring machine and enable the boring machine to adapt to the different engineering geological conditions, the cutter head of the boring machine is required to adapt to the dynamic changes of the load and provide relatively large torque and multiple rotational speed changes. Besides meeting the above requirements, the energy consumption of the system is further required to be decreased as far as possible, so as to improve the system reliability and working efficiency, and decrease the cost.

The conventional cutter head hydraulic system of the boring machine adopts multiple variable-displacement hydraulic motors which are arranged in parallel for outputting the torque and rotational speed. However, the variable-displacement hydraulic motor has a high cost; each variable-displacement hydraulic motor is configured with a motor flushing device independently, causing the higher cost; and moreover, compared with the fixed-displacement hydraulic motor, the variable-displacement hydraulic motor has lower reliability and working efficiency.

SUMMARY OF THE PRESENT INVENTION

In order to solve problems existing in the conventional cutter head hydraulic system of the boring machine described in prior art, the present invention provides a drive system with both fixed-displacement hydraulic motors and variable-displacement hydraulic motors for a cutter head of a boring machine and a control method thereof, for freely adjusting the cutter head system of the boring machine according to different working conditions, thereby decreasing an engineering cost and improving system efficiency and reliability.

Technical solutions of the present invention are described as follows.

A drive system with both fixed-displacement hydraulic motors and variable-displacement hydraulic motors for a cutter head of a boring machine comprises a variable-displacement hydraulic motor group, a fixed-displacement hydraulic motor group, and a variable-displacement hydraulic pump group, wherein: the variable-displacement hydraulic motor group, the fixed-displacement hydraulic motor group, and the variable-displacement hydraulic pump group are all connected to a main oil circuit of a cutter head system of the boring machine; the variable-displacement hydraulic pump group inputs flow to the main oil circuit; and, the variable-displacement hydraulic motor group and the fixed-displacement hydraulic motor group acquire flow from the main oil circuit.

Preferably, the drive system is constructed with both the fixed-displacement hydraulic motors and the variable-displacement hydraulic motors; displacements of the fixed-displacement hydraulic motor group and the variable-displacement hydraulic motor group are controlled in a way of displacement combination; and a rotational speed of the cutter head of the boring machine is determined by the displacements of the two motor groups and a displacement of the pump group.

Preferably, the variable-displacement hydraulic motor group comprises multiple variable-displacement hydraulic motors which are connected to the main oil circuit in parallel; two ends of each variable-displacement hydraulic motor are respectively connected to two circuits of the main oil circuit; that is to say, for each variable-displacement hydraulic motor, one end is connected to a first oil circuit A of the main oil circuit, and the other end is connected to a second oil circuit B of the main oil circuit; the variable-displacement hydraulic motors in the variable-displacement hydraulic motor group are controlled simultaneously or respectively; if the variable-displacement hydraulic motor group comprises e variable-displacement hydraulic motors, the e variable-displacement hydraulic motors can be controlled simultaneously or respectively.

Preferably, the fixed-displacement hydraulic motor group comprises multiple fixed-displacement hydraulic motors which are connected to the main oil circuit in parallel; two ends of each fixed-displacement hydraulic motor are respectively connected to the two circuits of the main oil circuit; that is to say, for each fixed-displacement hydraulic motor, one end is connected to the first oil circuit A of the main oil circuit, and the other end is connected to the second oil circuit B of the main oil circuit; if the fixed-displacement hydraulic motor group comprises f fixed-displacement hydraulic motors, the f fixed-displacement hydraulic motors can be controlled simultaneously.

Preferably, the number of the fixed-displacement hydraulic motors in the fixed-displacement hydraulic motor group is determined by taking an integer portion m of the motor number x obtained through calculating a formula of $$x = \frac{V}{V_{gmax}};$$

in the formula of $$x = \frac{V}{V_{gmax}},$$

$V_{g\ max}$ represents the maximum displacement of each fixed-displacement hydraulic motor, and V represents the required displacement of all motors for reaching a highest designed rotational speed, which is determined according to an actual engineering load.

Preferably, a total number of the variable-displacement hydraulic motors in the variable-displacement hydraulic motor group is n-m; n is the design motor number of the cutter head of the boring machine; a minimum value of displacement of each variable-displacement hydraulic motor is $$\frac{x-m}{n-m} \cdot V_{gmax},$$

and a designed maximum value is $V_{g\ max}'$; $V_{g\ max}'$ represents the maximum displacement of each variable-displacement hydraulic motor.

Preferably, each variable-displacement hydraulic motor adopts a variable-displacement hydraulic motor with a stepless displacement setting, particularly a hydraulic-proportion-controlled variable-displacement hydraulic motor or an electric-proportion-controlled variable-displacement hydraulic motor.

Preferably, each variable-displacement hydraulic motor adopts a variable-displacement hydraulic motor with two displacements of $V_{g\ min}$ and $V_{g\ max}$, particularly a two-point hydraulically controlled variable-displacement hydraulic motor or a two-point electrically controlled variable-displacement hydraulic motor.

Preferably, there are two ways to flush and cool bearings in the variable-displacement hydraulic motor group and the fixed-displacement hydraulic motor group. The first way is to adopt a flushing device in each motor. The second way is to adopt a motor concentrated flushing device shown in FIG. 2. The motor concentrated flushing device is connected between the variable-displacement hydraulic motor group, the fixed-displacement hydraulic motor group and the main oil circuit, comprising a speed regulation valve, an energy accumulator and a two-position three-way valve, wherein: a P port of the two-position three-way valve is connected to the second oil circuit B of the main oil circuit; a T port of the two-position three-way valve is connected to the first oil circuit A of the main oil circuit; an A port of the two-position three-way valve is connected to the energy accumulator through the speed regulation valve; a flow speed of oil is regulated through the speed regulation valve; the oil after passing through the speed regulation valve flows into motor housings of the variable-displacement hydraulic motor group and the fixed-displacement hydraulic motor group through a throttle value, so as to flush and cool the motor bearings; and the oil after flushing and cooling flows back to an oil tank. In order to avoid a peak occurrence of a flushing flow caused by a large oil pressure at a backpressure side during a braking process of the cutter head, the energy accumulator is connected to an oil circuit at a position before the oil enters the motors.

A method for controlling a drive system with both fixed-displacement hydraulic motors and variable-displacement hydraulic motors for a cutter head of a boring machine comprises steps of:

connecting both the fixed-displacement hydraulic motors and the variable-displacement hydraulic motors to a main oil circuit of a cutter head system of the boring machine, so as to construct the cutter head system of the boring machine; setting displacements of the fixed-displacement hydraulic motors and the variable-displacement hydraulic motors in a way of specific displacement combination; and controlling a rotational speed of the cutter head of the boring machine with the displacements of the fixed-displacement hydraulic motors and the variable-displacement hydraulic motors and displacements of variable-displacement hydraulic pumps.

Preferably, "setting displacements of the fixed-displacement hydraulic motors and the variable-displacement hydraulic motors in a way of specific displacement combination" particularly comprises steps of:

determining a required motor displacement V for reaching a highest designed rotational speed according to an actual engineering load; and calculating a required motor number x when the cutter head system of the boring machine works at a maximum displacement through a formula of $$x = \frac{V}{V_{gmax}},$$

wherein $V_{g\ max}$ represents a maximum displacement of each fixed-displacement hydraulic motor;

taking an integer portion m of the required motor number x as a total number of the fixed-displacement hydraulic motors in a fixed-displacement hydraulic motor group; and taking n-m as a total number of the variable-displacement hydraulic motors in a variable-displacement hydraulic motor group; wherein: n is the design motor number of the cutter head of the boring machine; and, n represents a total number of all motors in the variable-displacement hydraulic motor group and the fixed-displacement hydraulic motor group; and for the variable-displacement hydraulic motor group, setting a displacement range of each variable-displacement hydraulic motor to be $$\frac{x-m}{n-m} \cdot V_{gmax} \sim V'_{gmax},$$

namely setting a designed minimum value of displacement of each variable-displacement hydraulic motor to be $$\frac{x-m}{n-m} \cdot V_{gmax},$$

wherein $V_{g\ max}'$ represents a maximum displacement of each variable-displacement hydraulic motor.

Preferably, on premise of meeting designed rotational speed requirements of a main drive of the boring machine, the fixed-displacement hydraulic motors are adopted as much as possible and the number of the variable-displacement hydraulic motors is decreased as far as possible, so as to minimize the cost and improve the system reliability and efficiency.

Preferably, each variable-displacement hydraulic motor adopts a variable-displacement hydraulic motor with a stepless displacement setting, particularly a hydraulic-proportion-controlled variable-displacement hydraulic motor or an electric-proportion-controlled variable-displacement hydraulic motor.

Preferably, each variable-displacement hydraulic motor adopts a variable-displacement hydraulic motor with two displacements of $V_{g\ min}$ and $V_{g\ max}$, particularly a two-point hydraulically controlled variable-displacement hydraulic motor or a two-point electrically controlled variable-displacement hydraulic motor.

Control principles of the present invention are described as follows.

Firstly, the required motor displacement V for reaching the highest designed rotational speed is determined according to the actual engineering load; the maximum displacement of each fixed-displacement hydraulic motor is $V_{g\ max}$; the maximum displacement of each variable-displacement hydraulic motor is $V_{g\ max}'$; the design motor number of the cutter head of the boring machine is n; and, n represents the total number of all the motors in the variable-displacement hydraulic motor group and the fixed-displacement hydraulic motor group;

then, the required motor number x when all the motors work at the maximum displacement is determined through the formula of $$x = \frac{V}{V_{gmax}};$$

and next, the value of the integer portion of x is m, and the number of the fixed-displacement hydraulic motors is smaller than or equal to m; on the premise of meeting the designed rotational speed requirements, the fixed-displacement hydraulic motors are adopted as much as possible and the number of the variable-displacement hydraulic motors is decreased as far as possible, so as to achieve optimization; therefore, the number of the fixed-displacement hydraulic motors is determined to be m, the number of the variable-displacement hydraulic motors is determined to be n-m, the required total displacement of the variable-displacement hydraulic motors is $(x-m)\cdot V_{g\ max}$, the displacement of each variable-displacement hydraulic motor is $$\frac{x-m}{n-m}\cdot V_{gmax},$$

and the displacement range of each variable-displacement hydraulic motor is $$\frac{x-m}{n-m}\cdot V_{gmax} \sim V'_{gmax}.$$

In conclusion, the number of the fixed-displacement hydraulic motors is m; the number of the variable-displacement hydraulic motors is n-m; the displacement of each fixed-displacement hydraulic motor is $V_{g\ max}$; the displacement range of each variable-displacement hydraulic motor is $$V_{gmin} = \frac{x-m}{n-m}\cdot V_{gmax} \sim V'_{gmax},$$

namely the control starting value and ending value of the displacement of each variable-displacement hydraulic motor is determined.

Compared with the prior art, the present invention has following beneficial effects.

On the premise that the rotational speed of cutter head is adjustable and the range of the rotational speed meets the requirements, because the fixed-displacement hydraulic motors having the advantages of low cost, high reliability and high input accuracy are introduced into the system, the hydraulic system provided by the present invention is able to improve the system reliability and control accuracy, and decrease the engineering cost.

Meanwhile, the system has the relatively high flexibility and is able to flexibly select a combination way of the fixed-displacement hydraulic motors and the variable-displacement hydraulic motors according to the engineering requirements, which improves the engineering applicability of the cutter head system of the tunnel boring machine.

In figures: E1, E2, . . . , and Ee are all variable-displacement hydraulic motors; F1, F2, . . . , and Ff are all fixed-displacement hydraulic motors; G1, . . . , and Gg are all variable-displacement hydraulic pumps; "1" represents a throttle value; "2" represents a speed regulation valve; "3" represents an energy accumulator; and "4" represents a two-position three-way valve.

DETAILED DESCRIPTION OF THE PREFERRED EMBODIMENT

The present invention is further illustrated with accompanying drawings and preferred embodiments as follows.

Figure 1:
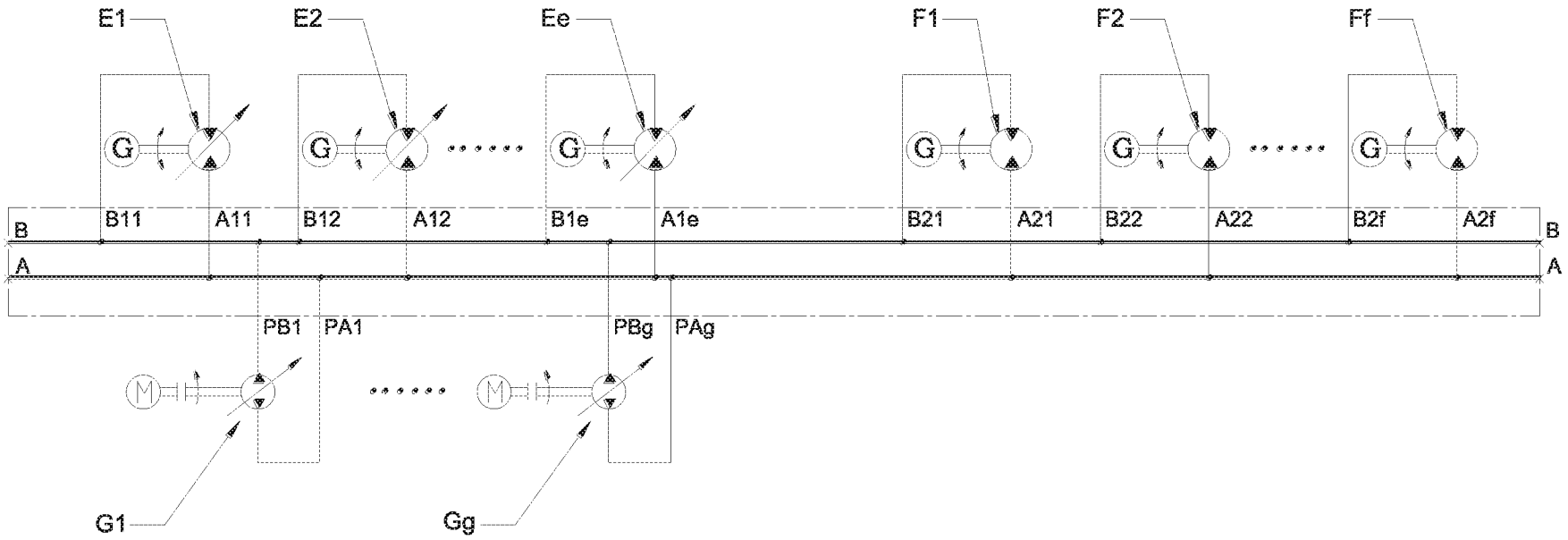
FIG. 1 is a principle sketch view of a combined system of variable-displacement hydraulic motors and fixed-displacement hydraulic motors according to the present invention.

As shown in FIG. 1, a system comprises e variable-displacement hydraulic motors, respectively E1, E2, . . . , and Ee, f fixed-displacement hydraulic motors, respectively F1, F2, . . . , and Ff, g variable-displacement hydraulic pumps, respectively G1, . . . , and Gg, and main oil circuits, respectively A and B, wherein: an oil port B11 of a first variable-displacement hydraulic motor E1 is connected to a second main oil circuit B, and an oil port A11 of the first variable-displacement hydraulic motor E1 is connected to a first main oil circuit A; an oil port B12 of a second variable-displacement hydraulic motor E2 is connected to the second main oil circuit B, and an oil port A12 of the second variable-displacement hydraulic motor E2 is connected to the first main oil circuit A; an oil port B1*e* of an $e^{th}$ variable-displacement hydraulic motor Ee is connected to the second main oil circuit B, and an oil port A1*e* of the $e^{th}$ variable-displacement hydraulic motor Ee is connected to the first main oil circuit A. It should be illustrated that: the number e of the variable-displacement hydraulic motors herein is determined by the above method; in figures, the variable-displacement hydraulic motors are briefly showed; and subscripts of B11 to B1*e* are used to represent the number e of the variable-displacement hydraulic motors, which is not a determined value; and all the variable-displacement hydraulic motors are connected to both of the main oil circuits A and B. An oil port B21 of a first fixed-displacement hydraulic motor F1 is connected to the second main oil circuit B, and an oil port A21 of the first fixed-displacement hydraulic motor F1 is connected to the first main oil circuit A; an oil port B22 of a second fixed-displacement hydraulic motor F2 is connected to the second main oil circuit B, and an oil port A22 of the second fixed-displacement hydraulic motor F2 is connected to the first main oil circuit A; an oil port B2*f* of an $f^{th}$ fixed-displacement hydraulic motor Ff is connected to the second main oil circuit B, and an oil port A2*f* of the $f^{th}$ fixed-displacement hydraulic motor Ff is connected to the first main oil circuit A. It should be illustrated that: the number f of the fixed-displacement hydraulic motors herein is determined by the above method; in figures, the fixed-displacement hydraulic motors are briefly showed; and subscripts of B21 to B2*f* are used to represent the number f of the fixed-displacement hydraulic motors, which is not a determined value; and all the fixed-displacement hydraulic motors are connected to both of the main oil circuits A and B. An oil port PB1 of a first variable-displacement hydraulic pump G1 is connected to the second main oil circuit B, and an oil port PA1 of the first variable-displacement hydraulic pump G1 is connected to the first main oil circuit A; an oil port PBg of a $g^{th}$ variable-displacement hydraulic pump Gg is connected to the second main oil circuit B, and an oil port PAg of the $g^{th}$ variable-displacement hydraulic pump Gg is connected to the first main oil circuit A. It should be illustrated that: the number g of the variable-displacement hydraulic pumps herein is determined according to actual requirements; in figures, the variable-displacement hydraulic pumps are briefly showed; and subscripts of PB1 to PBg are used to represent the number g of the variable-displacement hydraulic pumps, which is not a determined value; and all the variable-displacement hydraulic pumps are connected to both of the main oil circuits A and B.

The variable-displacement hydraulic motors, E1, E2, . . . , and Ee, have various types, for example, HD-type hydraulic-proportion-controlled variable-displacement hydraulic motor, HD.D-type hydraulic-proportion-controlled variable-displacement hydraulic motor with fixed setting pressure control, EP-type electric-proportion-controlled variable-displacement hydraulic motor, EP.D-type electric-proportion-controlled variable-displacement hydraulic motor with fixed pressure control, HZ-type two-point hydraulically controlled variable-displacement hydraulic motor, and EZ-type two-point electrically controlled variable-displacement hydraulic motor. It should be noted that: the above-described variable-displacement hydraulic motors are merely some types in the various variable-displacement hydraulic motors, and the present invention is also related to other types of variable-displacement hydraulic motors.

Figure 2:
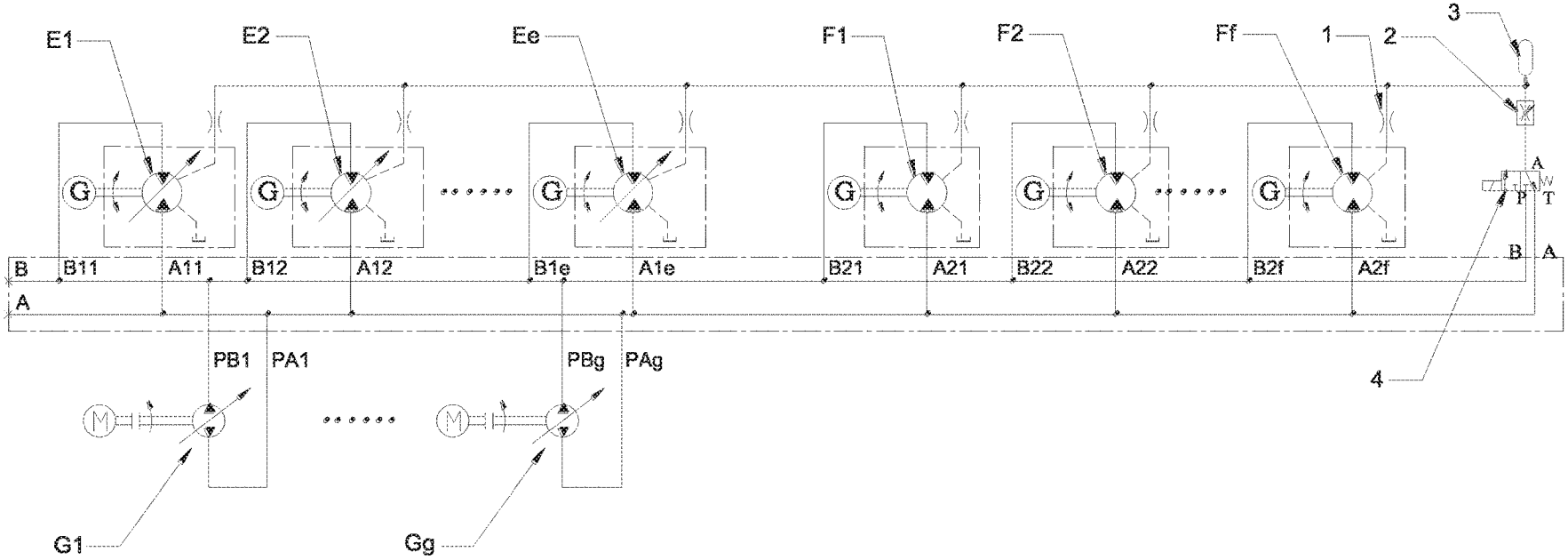
FIG. 2 is a principle sketch view of the combined system of the variable-displacement hydraulic motors and the fixed-displacement hydraulic motors with adding a motor concentrated flushing device according to the present invention.

FIG. 2 is a principle sketch view of the combined system of the variable-displacement hydraulic motors and the fixed-displacement hydraulic motors with adding a motor concentrated flushing device. The motor concentrated flushing device is connected between the variable-displacement hydraulic motor group, the fixed-displacement hydraulic motor group and the main oil circuits, comprising a speed regulation valve 2, an energy accumulator 3 and a two-position three-way valve 4, wherein: a P port of the two-position three-way valve 4 is connected to the second main oil circuit B; a T port of the two-position three-way valve 4 is connected to the first main oil circuit A; an A port of the two-position three-way valve 4 is connected to the energy accumulator 3 through the speed regulation valve 2; a flow speed of oil is regulated through the speed regulation valve 2; the energy accumulator 3 is respectively connected to motor housings of the variable-displacement hydraulic motor group and the fixed-displacement hydraulic motor group through a throttle value 1, so as to flush and cool the motor bearings; and the oil after flushing and cooling flows back to an oil tank. In order to avoid a peak occurrence of a flushing flow caused by a large oil pressure at a backpressure side during a braking process of the cutter head, the energy accumulator 3 is connected to an oil circuit at a position before the oil enters the motors.

Preferred embodiments of the present invention are described as follows.

First Preferred Embodiment

For the system shown in FIG. 1, according to the actual engineering load and other limit conditions, the required motor total number n is determined to be n=8, the required motor displacement is V=2200 $cm^3$, and the maximum displacement of each fixed-displacement hydraulic motor and each variable-displacement hydraulic motor is $V_{g\ max}$=500 $cm^3$. Thus, the required number of the motors at the maximum displacement is $$x = \frac{V}{V_{gmax}} = \frac{2200}{500} = 4.4,$$

and the number of the fixed-displacement hydraulic motors should be smaller than or equal to 4. With the principle of optimality, the fixed-displacement hydraulic motors should be adopted as much as possible, and the number of the variable-displacement hydraulic motors should be decreased as far as possible, so that the maximum value 4 is taken; that is to say, the number of the fixed-displacement hydraulic motors is m=4, and the number of the variable-displacement hydraulic motors is n−m=8−4=4; the total displacement required to be provided by the variable-displacement hydraulic motors is $(x-m)\cdot V_{g\ max}=(4.4-4)\cdot V_{g\ max}=0.4\cdot V_{g\ max}$=200 $cm^3$; and the minimum displacement of each variable-displacement hydraulic motor is $$V_{gmin} = \frac{x-m}{n-m}\cdot V_{gmax} = \frac{4.4-4}{8-4}\times 500 = 50\ cm^3.$$

Therefore, it is determined that: the number of the fixed-displacement hydraulic motors is 4; the number of the variable-displacement hydraulic motors is 4; and the displacement range of each variable-displacement hydraulic motor is 50 $cm^3$ 500 $cm^3$.

Second Preferred Embodiment

For the system shown in FIG. 1, according to the actual engineering load and other limit conditions, the required motor total number n is determined to be n=9, the required motor displacement is V=2475 $cm^3$, and the maximum displacement of each fixed-displacement hydraulic motor and each variable-displacement hydraulic motor is $V_{g\ max}$=500 cm$^3$. Thus, the required number of the motors at the maximum displacement is $$x = \frac{V}{V_{gmax}} = \frac{2475}{500} = 4.95,$$

and the number of the fixed-displacement hydraulic motors should be smaller than or equal to 4. With the principle of optimality, the fixed-displacement hydraulic motors should be adopted as much as possible, and the number of the variable-displacement hydraulic motors should be decreased as far as possible, so that the maximum value 4 is taken; that is to say, the number of the fixed-displacement hydraulic motors is m=4, and the number of the variable-displacement hydraulic motors is n-m=9−4=5; the total displacement required to be provided by the variable-displacement hydraulic motors is $(x-m)\cdot V_{g\ max}=(4.95-4)\cdot V_{g\ max}=0.95\cdot V_{g\ max}$=475 cm$^3$; and the minimum displacement of each variable-displacement hydraulic motor is $$V_{g\,min} = \frac{4.95-4}{9-4} \times 500 = 95\,\text{cm}^3.$$

Therefore, it is determined that: the number of the fixed-displacement hydraulic motors is 4; the number of the variable-displacement hydraulic motors is 5; and the displacement range of each variable-displacement hydraulic motor is 95 cm$^3$ 500 cm$^3$.

Third Preferred Embodiment

For the system shown in FIG. 1, according to the actual engineering load and other limit conditions, the required motor total number n is determined to be n=7, the required motor displacement is V=2000 cm$^3$, and the maximum displacement of each fixed-displacement hydraulic motor and each variable-displacement hydraulic motor is $V_{g\ max}$=500 cm$^3$. Thus, the required number of the motors at the maximum displacement is $$x = \frac{V}{V_{g\,max}} = \frac{2000}{500} = 4,$$

and the number of the fixed-displacement hydraulic motors should be smaller than or equal to 4. With the principle of optimality, the fixed-displacement hydraulic motors should be adopted as much as possible, and the number of the variable-displacement hydraulic motors should be decreased as far as possible, so that the maximum value 4 is taken; that is to say, the number of the fixed-displacement hydraulic motors is m=4, and the number of the variable-displacement hydraulic motors is n−m=7−4=3; the total displacement required to be provided by the variable-displacement hydraulic motors is $(x-m)\cdot V_{g\ max}=(4-4)\cdot V_{g\ max}=0\cdot V_{g\ max}=0$; and the minimum displacement of each variable-displacement hydraulic motor is $$V_{g\,min} = \frac{x-m}{n-m} \cdot V_{g\,max} = 0\,\text{cm}^3.$$

Therefore, it is determined that: the number of the fixed-displacement hydraulic motors is 4; the number of the variable-displacement hydraulic motors is 3; and the displacement range of each variable-displacement hydraulic motor is 0 cm$^3$ 500 cm$^3$.

The above illustrated preferred embodiments further describe the objects, technical solutions and beneficial effects of the present invention in detail. It should be understood that the above preferred embodiments are not for limiting the present invention. All modifications, equivalent replacements, and improvements made within the spirit and principle of the present invention are included in the protection scope of the present invention.

What is claimed is:

1. A drive system with both fixed-displacement hydraulic motors and variable-displacement hydraulic motors for a cutter head of a boring machine, comprising a variable-displacement hydraulic motor group, a fixed-displacement hydraulic motor group, and a variable-displacement hydraulic pump group, wherein: the variable-displacement hydraulic motor group, the fixed-displacement hydraulic motor group, and the variable-displacement hydraulic pump group are all connected to a main oil circuit of a cutter head system of the boring machine; the variable-displacement hydraulic pump group inputs flow to the main oil circuit; and, the variable-displacement hydraulic motor group and the fixed-displacement hydraulic motor group acquire flow from the main oil circuit.

2. The drive system with both the fixed-displacement hydraulic motors and the variable-displacement hydraulic motors for the cutter head of the boring machine, as recited in claim 1, wherein: the drive system is constructed with both the fixed-displacement hydraulic motors and the variable-displacement hydraulic motors; displacements of the fixed-displacement hydraulic motor group and the variable-displacement hydraulic motor group are set in a way of displacement combination; and a rotational speed of the cutter head of the boring machine is determined by the displacements of the two motor groups and a displacement of the pump group.

3. The drive system with both the fixed-displacement hydraulic motors and the variable-displacement hydraulic motors for the cutter head of the boring machine, as recited in claim 2, wherein: the variable-displacement hydraulic motor group comprises multiple variable-displacement hydraulic motors which are connected to the main oil circuit in parallel; two ends of each variable-displacement hydraulic motor are respectively connected to two circuits of the main oil circuit; the variable-displacement hydraulic motors in the variable-displacement hydraulic motor group are controlled simultaneously or respectively.

4. The drive system with both the fixed-displacement hydraulic motors and the variable-displacement hydraulic motors for the cutter head of the boring machine, as recited in claim 3, wherein: the number of the fixed-displacement hydraulic motors in the fixed-displacement hydraulic motor group is determined by taking an integer portion m of a motor number x obtained through calculating a formula of $$x = \frac{V}{V_{g\,max}};$$

in the formula of $$x = \frac{V}{V_{g\,max}},$$

$V_{g\ max}$ represents a maximum displacement of each fixed-displacement hydraulic motor, and V represents a required motor displacement for reaching a highest designed rotational speed, which is determined according to an actual engineering load; and the number of the variable-displacement hydraulic motors in the variable-displacement hydraulic motor group is n−m; n is a design motor number of the cutter head of the boring machine; a designed minimum value of displacement of each variable-displacement hydraulic motor is $$\frac{x-m}{n-m} \cdot V_{g\,max},$$

and a designed maximum value is $V_{g\ max}'$; $V_{g\ max}'$ represents the maximum displacement of each variable-displacement hydraulic motor.

5. The drive system with both the fixed-displacement hydraulic motors and the variable-displacement hydraulic motors for the cutter head of the boring machine, as recited in claim 4, wherein: each variable-displacement hydraulic motor adopts a variable-displacement hydraulic motor with a stepless displacement setting, particularly a hydraulic-proportion-controlled variable-displacement hydraulic motor or an electric-proportion-controlled variable-displacement hydraulic motor.

6. The drive system with both the fixed-displacement hydraulic motors and the variable-displacement hydraulic motors for the cutter head of the boring machine, as recited in claim 4, wherein: each variable-displacement hydraulic motor adopts a variable-displacement hydraulic motor with two displacements of $V_{g\ min}$ and $V_{g\ max}$, particularly a two-point hydraulically controlled variable-displacement hydraulic motor or a two-point electrically controlled variable-displacement hydraulic motor.

7. The drive system with both the fixed-displacement hydraulic motors and the variable-displacement hydraulic motors for the cutter head of the boring machine, as recited in claim 2, wherein: the fixed-displacement hydraulic motor group comprises multiple fixed-displacement hydraulic motors which are connected to the main oil circuit in parallel; two ends of each fixed-displacement hydraulic motor are respectively connected to two circuits of the main oil circuit.

8. The drive system with both the fixed-displacement hydraulic motors and the variable-displacement hydraulic motors for the cutter head of the boring machine, as recited in claim 7, wherein: the number of the fixed-displacement hydraulic motors in the fixed-displacement hydraulic motor group is determined by taking an integer portion m of a motor number x obtained through calculating a formula of $$x = \frac{V}{V_{g\,max}};$$

in the formula of $$x = \frac{V}{V_{g\,max}},$$

$V_{g\ max}$ represents a maximum displacement of each fixed-displacement hydraulic motor, and V represents a required motor displacement for reaching a highest designed rotational speed, which is determined according to an actual engineering load; and the number of the variable-displacement hydraulic motors in the variable-displacement hydraulic motor group is n−m; n is a design motor number of the cutter head of the boring machine; a designed minimum value of displacement of each variable-displacement hydraulic motor is $$\frac{x-m}{n-m} \cdot V_{g\,max},$$

and a designed maximum value is $V_{g\ max}'$; $V_{g\ max}'$ represents the maximum displacement of each variable-displacement hydraulic motor.

9. The drive system with both the fixed-displacement hydraulic motors and the variable-displacement hydraulic motors for the cutter head of the boring machine, as recited in claim 8, wherein: each variable-displacement hydraulic motor adopts a variable-displacement hydraulic motor with a stepless displacement setting, particularly a hydraulic-proportion-controlled variable-displacement hydraulic motor or an electric-proportion-controlled variable-displacement hydraulic motor.

10. The drive system with both the fixed-displacement hydraulic motors and the variable-displacement hydraulic motors for the cutter head of the boring machine, as recited in claim 8, wherein: each variable-displacement hydraulic motor adopts a variable-displacement hydraulic motor with two displacements of $V_{g\ min}$ and $V_{g\ max}$, particularly a two-point hydraulically controlled variable-displacement hydraulic motor or a two-point electrically controlled variable-displacement hydraulic motor.

11. The drive system with both the fixed-displacement hydraulic motors and the variable-displacement hydraulic motors for the cutter head of the boring machine, as recited in claim 1, wherein: the variable-displacement hydraulic motor group comprises multiple variable-displacement hydraulic motors which are connected to the main oil circuit in parallel; two ends of each variable-displacement hydraulic motor are respectively connected to two circuits of the main oil circuit; the variable-displacement hydraulic motors in the variable-displacement hydraulic motor group are controlled simultaneously or respectively.

12. The drive system with both the fixed-displacement hydraulic motors and the variable-displacement hydraulic motors for the cutter head of the boring machine, as recited in claim 1, wherein: the fixed-displacement hydraulic motor group comprises multiple fixed-displacement hydraulic motors which are connected to the main oil circuit in parallel; two ends of each fixed-displacement hydraulic motor are respectively connected to two circuits of the main oil circuit.

13. The drive system with both the fixed-displacement hydraulic motors and the variable-displacement hydraulic motors for the cutter head of the boring machine, as recited in claim 1, wherein: the number of the fixed-displacement hydraulic motors in the fixed-displacement hydraulic motor group is determined by taking an integer portion m of a motor number x obtained through calculating a formula of $$x = \frac{V}{V_{g\,max}};$$

in the formula of $$x = \frac{V}{V_{g\,max}},$$

$V_{g\ max}$ represents a maximum displacement of each fixed-displacement hydraulic motor, and V represents a required motor displacement for reaching a highest designed rotational speed, which is determined according to an actual engineering load; and the number of the variable-displacement hydraulic motors in the variable-displacement hydraulic motor group is n−m; n is a design motor number of the cutter head of the boring machine; a designed minimum value of displacement of each variable-displacement hydraulic motor is $$\frac{x-m}{n-m} \cdot V_{g\,max},$$

and a designed maximum value is $V_{g\ max}'$; $V_{g\ max}'$ represents the maximum displacement of each variable-displacement hydraulic motor.

14. The drive system with both the fixed-displacement hydraulic motors and the variable-displacement hydraulic motors for the cutter head of the boring machine, as recited in claim 1, further comprising a motor concentrated flushing device which is connected between the variable-displacement hydraulic motor group, the fixed-displacement hydraulic motor group and the main oil circuit, wherein: the motor concentrated flushing device comprises a speed regulation valve (2), an energy accumulator (3) and a two-position three-way valve (4); a P port of the two-position three-way valve (4) is connected to a second oil circuit B of the main oil circuit; a T port of the two-position three-way valve (4) is connected to a first oil circuit A of the main oil circuit; an A port of the two-position three-way valve (4) is connected to the energy accumulator (3) through the speed regulation valve (2); a flow speed of oil is regulated through the speed regulation valve (2); the oil after passing through the speed regulation valve (2) flows into motor housings of the variable-displacement hydraulic motor group and the fixed-displacement hydraulic motor group through a throttle value (1), so as to flush and cool motor bearings; and the oil after flushing and cooling flows back to an oil tank.

15. A method for controlling a drive system with both fixed-displacement hydraulic motors and variable-displacement hydraulic motors for a cutter head of a boring machine, comprising steps of:

connecting both the fixed-displacement hydraulic motors and the variable-displacement hydraulic motors to a main oil circuit of a cutter head system of the boring machine, so as to construct the hydraulic drive system for the cutter head of the boring machine; setting displacements of the fixed-displacement hydraulic motors and the variable-displacement hydraulic motors in a way of specific displacement combination; and controlling a rotational speed of the cutter head of the boring machine with the displacements of the fixed-displacement hydraulic motors and the variable-displacement hydraulic motors and displacements of variable-displacement hydraulic pumps.

16. The method for controlling the drive system with both the fixed-displacement hydraulic motors and the variable-displacement hydraulic motors for the cutter head of the boring machine, as recited in claim 15, wherein "setting displacements of the fixed-displacement hydraulic motors and the variable-displacement hydraulic motors in a way of specific displacement combination" particularly comprises steps of:

determining a required motor displacement V for reaching a highest designed rotational speed according to an actual engineering load; and calculating a required motor number x when the cutter head system of the boring machine works at a maximum displacement through a formula of $$x = \frac{V}{V_{g\,max}},$$

wherein $V_{g\ max}$ represents a maximum displacement of each fixed-displacement hydraulic motor;

taking an integer portion m of the required motor number x as a total number of the fixed-displacement hydraulic motors in a fixed-displacement hydraulic motor group; and taking n−m as a total number of the variable-displacement hydraulic motors in a variable-displacement hydraulic motor group; wherein: n is the design motor number of the boring machine; and, n represents a total number of all motors in the variable-displacement hydraulic motor group and the fixed-displacement hydraulic motor group; and for the variable-displacement hydraulic motor group, setting a displacement range of each variable-displacement hydraulic motor to be $$\frac{x-m}{n-m} \cdot V_{g\,max} \sim V'_{g\,max},$$

namely setting a designed minimum value of displacement of each variable-displacement hydraulic motor to be $$\frac{x-m}{n-m} \cdot V_{g\,max},$$

wherein $V_{g\ max}'$ represents a maximum displacement of each variable-displacement hydraulic motor.

17. The method for controlling the drive system with both the fixed-displacement hydraulic motors and the variable-displacement hydraulic motors for the cutter head of the boring machine, as recited in claim 16, wherein: each variable-displacement hydraulic motor adopts a variable-displacement hydraulic motor with a stepless displacement setting, particularly a hydraulic-proportion-controlled variable-displacement hydraulic motor or an electric-proportion-controlled variable-displacement hydraulic motor.

18. The method for controlling the drive system with both the fixed-displacement hydraulic motors and the variable-displacement hydraulic motors for the cutter head of the boring machine, as recited in claim 16, wherein: each variable-displacement hydraulic motor adopts a variable-displacement hydraulic motor with two displacements of $V_g$ and $V_g$, particularly a two-point hydraulically controlled variable-displacement hydraulic motor or a two-point electrically controlled variable-displacement hydraulic motor.

19. The method for controlling the drive system with both the fixed-displacement hydraulic motors and the variable-displacement hydraulic motors for the cutter head of the boring machine, as recited in claim 15, wherein: each variable-displacement hydraulic motor adopts a variable-displacement hydraulic motor with a stepless displacement setting, particularly a hydraulic-proportion-controlled variable-displacement hydraulic motor or an electric-proportion-controlled variable-displacement hydraulic motor.

20. The method for controlling the drive system with both the fixed-displacement hydraulic motors and the variable-displacement hydraulic motors for the cutter head of the boring machine, as recited in claim 15, wherein: each variable-displacement hydraulic motor adopts a variable-displacement hydraulic motor with two displacements of $V_{g\ min}$ and $V_{g\ max}$, particularly a two-point hydraulically controlled variable-displacement hydraulic motor or a two-point electrically controlled variable-displacement hydraulic motor.

* * * * *